United States Patent [19]

Eberle

[11] Patent Number: 4,620,474

[45] Date of Patent: Nov. 4, 1986

[54] DRIVE MECHANISM FOR TRANSMITTING FORCE AND MOTION ALONG A PATH

[75] Inventor: Jürg Eberle, Hinwil, Switzerland

[73] Assignee: Feramatic AG, Duernten, Switzerland

[21] Appl. No.: 608,246

[22] Filed: May 8, 1984

[30] Foreign Application Priority Data

May 17, 1983 [CH] Switzerland ..... 2685/83

[51] Int. Cl.[4] ..... F01B 29/00

[52] U.S. Cl. ..... 91/418; 91/DIG. 4; 92/88; 92/107; 92/137

[58] Field of Search ..... 92/88, 107, 137; 91/418, DIG. 4

[56] References Cited

U.S. PATENT DOCUMENTS

| | | | |
|---|---|---|---|
| 2,473,430 | 6/1949 | Hoffar | 92/88 |
| 3,965,802 | 6/1976 | Jacobs | 92/137 |
| 4,373,427 | 2/1983 | Garlapaty | 92/88 |
| 4,467,705 | 8/1984 | Reist | 92/137 |
| 4,472,981 | 9/1984 | Peter | 92/137 |
| 4,481,869 | 11/1984 | Garlapaty | 92/88 |

FOREIGN PATENT DOCUMENTS

| | | |
|---|---|---|
| 0057818 | 8/1982 | European Pat. Off. . |
| 1086042 | 10/1967 | United Kingdom . |
| 2110303A | 6/1983 | United Kingdom . |

*Primary Examiner*—Abraham Hershkovitz
*Attorney, Agent, or Firm*—Walter C. Farley

[57] ABSTRACT

A drive mechanism with a fluid-operable system can be adapted to a general path configuration. The mechanism includes coaxial tubes following a desired path configuration with the inner tube longitudinally slotted in a sealable manner. A fluid-actuated annular piston surrounds the inner tube and operates in the chamber between the inner and outer tubes with a member extending therefrom toward the piston center and extending in the inner tube slot. A flexible force transmission member is provided within the inner tube and extends longitudinally therein, transmitting the motion or force of the piston to a location of use.

17 Claims, 6 Drawing Figures

DRIVE MECHANISM FOR TRANSMITTING FORCE AND MOTION ALONG A PATH

This invention relates to a drive mechanism including a tubular housing and a force transmitting member for transmitting force or motion, or both, along a path followed by the tubular housing.

BACKGROUND OF THE INVENTION

Drives for various forms of discontinuous movement, particularly for pulling and for percussive movements, usually involve pneumatically or hydraulically operated means with driven pistons and with a piston rod transmitting the movement or force to the outside of a cylinder. Linear transporters can operate without a piston rod and the movement work accomplished by the driven piston is coupled to the outside by a longitudinally extending slot provided in a cylinder and, further, there is commonly a force reversal involving a mechanical coupling and a slide. A linear transporter operating without such a piston rod generally has somewhat more than half the overall length of the conventional piston arrangement involving a piston rod and, as a result of the considerably shortened overall length, solves certain arrangement and positioning problems. Although reduced overall lengths can be necessary and important for certain arrangements or for the installation of a drive within an apparatus, and although such arrangements can be achieved with commercially available linear drives of the desired length, it frequently occurs that the force to be used must still be reversed to bring it to the right place.

Instead of constructing the device around the drive or adapting the concept of the device to the physical shape of an available drive, it is theoretically possible to adapt the drive, in this case a linear drive, to the device to be driven. However, it is not always possible to easily reverse the action tasks of systems having relative actions such that, for example, instead of the dentist's drill it is the patient who is rotated. It must be recognized that there are insurmountable factual compulsions which must be respected and preference must be given to long-established experience in this respect.

Such factual constraints are also present in a system having a drive and a driven device and attempts have been made to counteract these by shortening the overall length in the case of the linear drive. Considerable improvement regarding the overall length is provided by the omission of the piston rod. Apart from the "floating piston" of the Sterling motor, this idea which avoids previously existing concepts is not particularly old.

The generation of forces along a general path and the transfer of those forces to an action point would make it possible to nevertheless use such a drive within certain structural limitations in already designed means or in those where drives of the previously mentioned type can be used only with topographical difficulties. Importance must not be attached to the fact that the point at which the force is to ultimately be used is not on the action line of the drive because the path along which the force passes can be brought in virtually any desired way to such a point.

BRIEF SUMMARY OF THE INVENTION

An object of the present invention is to provide an improved drive which is capable of being used under a variety of circumstances for transmitting force or motion and which is adaptable to circumstances in which more conventional drives could not be employed.

Briefly described, the invention includes a drive mechanism comprising a first tubular member following a predetermined path (linear or non-linear) and a second tubular member which substantially concentrically surrounds and is spaced from the first member and following the same path. At longitudinally spaced locations there are means for closing the space between the first and second members, thereby defining an elongated annular chamber. A piston surrounds the first member in the chamber and there are means for selectively introducing fluid under pressure into the chamber to cause longitudinal movement of the piston. Within the first tubular member is a flexible transmission member. Finally, the structure includes means for coupling the movement of the piston through the wall of the first tubular member to exert force on the transmission member.

In a preferred embodiment, the transmission member is a substantially unstretchable, tensile or compressive force-absorbing hemispherical link chain with conical movement characteristics and with guide tubes for the chain connected to the ends of the first tubular member and acting as extensions of the path. In a generalized form, the path can follow any curve or, in a special case, can be straight.

BRIEF DESCRIPTION OF THE DRAWINGS

In order that the manner in which the foregoing and other objects are attained in accordance with the invention can be understood in detail, particularly advantageous embodiments thereof will be described with reference to the accompanying drawings, which form a part of this specification, and wherein.

DETAILED DESCRIPTION OF PREFERRED EMBODIMENTS

Figure 1:
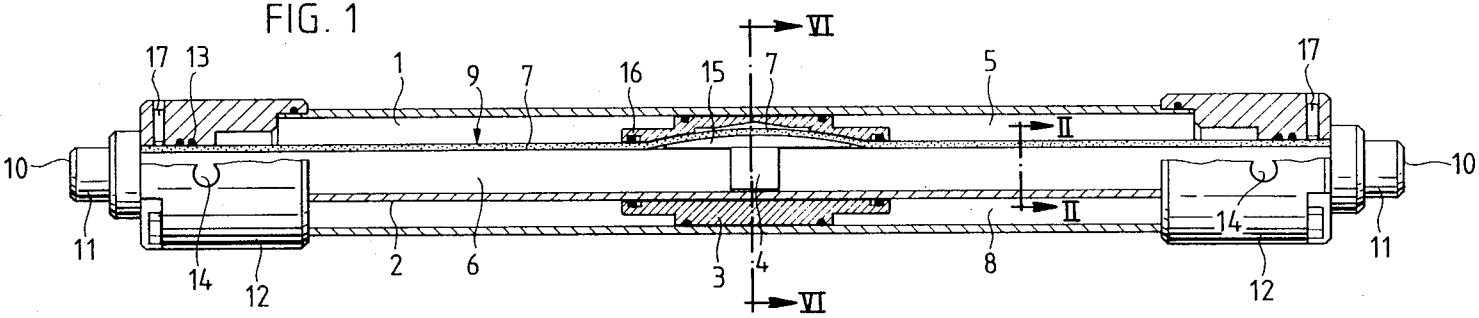
FIG. 1 is a side elevation in partial section of a portion of a linear drive in accordance with the present invention.

FIG. 1 is a sectional view, partly schematic, of a drive means in accordance with the invention in a linear form which will be recognized as a special case of a general curvilinear path having infinite radius. This mode of representation has been used in order to illustrate the principal of construction, but it will be clear that the invention is by no means limited to this special case.

The drive mechanism is shown in FIG. 1 in an incomplete form, lacking guide means and a transmission element which will be described hereinafter. The structure of FIG. 1 includes a twin tube structure including a first tubular member 2 and a second tubular member 1 in which tube 1 is completely metal, tube 2 having a smaller diameter and the tubes being coaxially related. The tubes are held in a concentric relationship by end pieces 12. In manifestations of the device where the tubes have considerable overall length relative to the tube wall thickness, as will be discussed hereinafter, one or the other of the tubes can sag relative to the other to some extent as a result of gravity despite a degree of structural stiffness in the tubes. Thus, the annular chamber formed between the tubes will be eccentric for a portion of the length of the drive. A fluid-operable annular piston 3 is arranged in the chamber 5 which is the hollow annular space between the two tubes, the piston being operable in either of two directions as a result of its symmetrical construction. Piston 3 has a member 4 coupled thereto and directed inwardly diametrically across the piston center and projecting from the outer chamber 5 into the inner chamber 6 within tube 2 through a longitudinally formed slot 9 in the inner tube. In the linear example of the type shown here, the slot 9 is essentially straight. However, it will be recognized that in curved embodiments the slot can coil or spiral around an imaginary central main line or fiber. Within chamber 6 a transmission member will be provided, the transmission member being that which conveys force or motion to the environment. It will be recognized that chamber 6 need not be sealed from the ambient atmosphere because that chamber operates with atmospheric pressure. The pressure which performs the work is provided in the outer chamber 5, 8 in which the annular piston 3 is activated. Chambers 6 and 5 are separated from each other by a sealing strip 7. This sealing strip can be partially inserted into longitudinal slot 9 and is constructed in such a way that it is forced in the direction of increasing sealing action by the pressure difference between the two chambers. The basic structure is completed by the provision of fluid openings 14 in end pieces 12 which are conventional apertures or fittings through which a fluid medium under pressure can be supplied to produce the pressure difference which causes piston 3 to move or exert force. Pressure chamber 8 is sealed by packing rings such as rings 13 supplied in the end pieces. The end pieces also include end fittings 11 which can be connected to guide means, to be described hereinafter, for guiding the transmission member.

Figure 2:
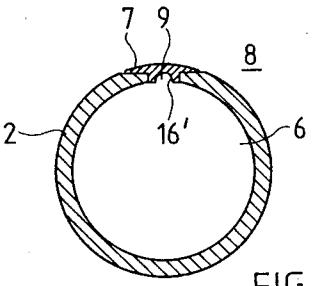
FIG. 2 is a partial transverse sectional view along line II—II of FIG. 1.

It will be apparent that annular piston 3 is longitudinally displaceable within the twin tube structure. In order to permit mechanical communication between chamber 5, 8 and the transmission member in chamber 6, the sealing strip which separates the chambers is lifted away from the slot by a sliding cam 15 which is connected to and moves with piston 3, the sealing strip being lifted at the front end of the piston, considering the direction of motion, and is returned again to the sealing position by a follower fixed cam 16. As shown in FIG. 2, as a result of the construction or profiling of sealing strip 7, cam 16 can be designed to act simultaneously as a packing ring for piston 3, encircling tube 2 and also the sealing strip. When a gaseous fluid is used as the pressure medium, i.e., in a pneumatic embodiment of the structure, the sealing requirements are less strict, and this solution can be recommended because, in general, a slight coiling of the coaxial tube slot 9 about an imaginary central fiber is permitted and, in the case of a twisting twin tube structure which passes along a general curvilinear path in accordance with the invention, such coiling can only be avoided with considerable effort and expenditure.

The concentrically arranged structure of the twin tubes is provided, in the case of simple curvatures, in such a way that two appropriately prebent tubes of different diameters are telescopically assembled and end pieces 12 are applied to center and maintain the tubes in their concentric relationship. The "sags" occurring toward the center of the twin tube structure, resulting in slight decentering, are temporarily removed by the passing of annular piston 3. This makes is easily possible to construct both of the tubes from metal.

In an embodiment which requires double curvatures, i.e., an arrangement in which the active cylinder follows a sigmoid course, a flexible outer tube 1 is passed over an appropriately preformed inner tube 2 in order to avoid the difficulties inherent in jointly bending two telescoped tubes. It is preferred to use those flexible types of tubes which can be brought with relatively little force into a curvature and which does not automatically lose the curvature again. Thus, after fitting the outer tube onto the prebent inner tube, in a first stage the desired curvature can be roughly approximated and in a second stage fine rebending can take place by pushing a template corresponding to the annular piston dimensions through the annular space between the tubes. As described, the remaining decentering is temporarily removed by the traversing annular piston. The bearing member is then the rigid inner tube from which the jacket tube is substantially concentrically spaced. The thinner and more flexible the jacket tube, the less strictly this requirement must be fulfilled. Thus, centering by the action of annular piston 3 takes place more easily the less rigid the mass which acts against it. It is therefore necessary to optimize the pneumatic pressure, the minimum extensibility of the jacket tube 1 despite adequate flexibility, and also the wall thickness and length of the tube. In embodiments involving greater length other means such as external supports can be provided at selected points of the cylinder.

The required low extensibility of the jacket tube for maintaining the nominal diameter is provided, for example, by most types of high pressure hose where the inner tube has relatively high strength and thermal stability and which is conventionally also surrounded by a high to very high tensile strength netting. In addition, these high pressure hoses are surrounded by a wear-resistant outer netting. A hose surrounded by a metal coil or armored tube is even better and, as stated previously, maintains the bend imparted to it. Naturally, these hoses or tubes are designed for much higher operating pressure than used in the present invention. The overdimensioned wall thickness thus functions for the tube-like strength.

As previously stated, annular piston 3 is constructed symmetrically. This also applies to the sliding cam 15 for opening the seal as well as to the fixed cams 16 at opposite ends of the piston for reclosing the seal and acting as packing rings for the coaxial tube. The number of turns per unit length of the coiling system is limited by the material and shape of seal strip 7. Thus, it is not the function of this additional rotary degree of freedom of the annular piston to be able to traverse very tight turns and its function is, in fact, to make it compatible with coiling with results from the construction of the drive. The coils resulting from the production of twisting twin tubes are generally smaller than 360 degrees per meter with no problems for the present seal.

This additional degree of freedom of the annular piston, i.e., the rotational movement superimposed upon the translational movement, must be transmitted, as a function of the force transmission means, in such a way that there is no energy storage. In a device having a relatively small overall length, such storage could be permitted because no harmful material loading results from a slight twisting of the force transmission means which would be removed again upon reverse movement of the piston. However, in the case of greater overall length, i.e., 5 to 10 meters or more, the force transmission would supply this rotary movement to the driven unit as a detectable torque. There would also be a risk of increased wear to a force transmission member not provided for this.

If the drive is to take the form of a multiply twisted path having complex curvature in space in, for example, a complex installation which passes entirely or partly through and within a wall or the like, the quasicoaxial course of the coaxial tube would often deviate significantly from concentricity. It has not been considered necessary to try such an arrangement so far, but in a less exotic path configuration, there is a temporary centering of the traversing piston without any disturbing hinderance, i.e., without any excessive deceleration by radial forces. This is dependent upon the dimensioning of the drive and the power level. Genuine binding need not be feared within normal limits. However, when high synchronism is required, it would be appropriate to provide an optimization in this connection.

For the solution of structural problems, it is advantageous to leave the outwardly closed shape free of projecting parts and without the factual compulsion of "paths" for a slide. The drive can be concreted in without this impairing the function. A further advantage is that, even in the case of a linear drive, the characteristics are attained, i.e., the special case of curvature with an infinite radius is incorporated therein. The sealing of the pressure chamber can be accomplished with the same means in the case of curved or straight embodiments.

FIG. 2 shows an example for the sealing of the slotted inner tube. Tube 2 with slot 9 is appropriately pressure-sealed with a simple sealing strip having a profile as shown by strip 7. Pressure chamber 8 is located outside of tube 2 and lower pressure prevails in the inner chamber 6. The pressure acts in such a way that the profile 7 in gap 9 tends to spread apart and the sealing lips 16 press outwardly against the tube wall. In operation, this seal is operated and closed again a vast number of times so that high demands are made of the material and the shape. The sealing strip is held in its end position on end pieces 12 by a sealing strip fixture 17, seen in FIG. 1, the selected profile being responsible to the correct seating on the often long coaxial inner tube.

Figure 3:
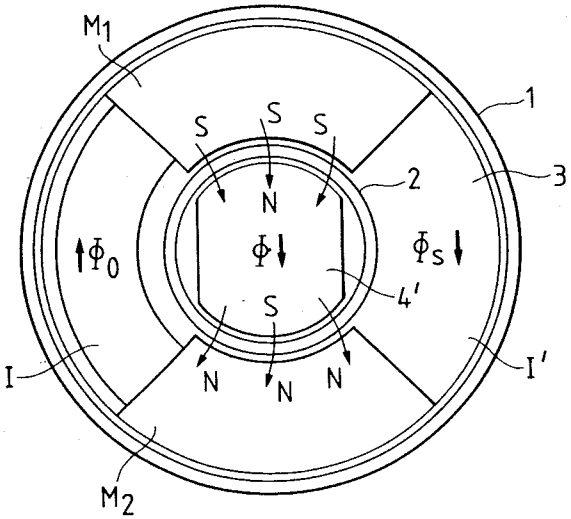
FIG. 3 is a transverse sectional view of a further embodiment of an apparatus in accordance with the invention schematically showing a magnetic coupling for force transfer.

Member 4 which is attached to annular piston 3 projects through slot 9 to transfer longitudinal, and possibly also torsional, forces. As previously mentioned, strip 7 is used for sealing the slot and is moved out of slot 9 to make a place for member 4 by sliding cam 15 and is then returned to its place again by cam 16. FIG. 3 shows a further embodiment in which a high flux density magnet 4' takes the place of member 4. Magnetic 4' is acted on by drag magnets M1 and M2 arranged in the annular piston 3, the magnets M1, M2 being constructed as armature legs connected to a yoke. Thus, between these armature legs, each representing a magnetic south or north pole, and which engage as continuously as possible against the outer wall of tube 2, is arranged the magnet 4' which is oriented in accordance with the magnetic polarity of the outer legs. Tube 2 in this embodiment is constructed without a slot but must be made from a nonmagnetic material. The minimum quality of the total magnetic flux for the magnetic circuit including leg, M1, the wall of inner tube 2, magnetic 4', the inner tube wall, magnet M2 and the yoke, in order to ensure an adequate transverse force for the thrust on the force transmission means can be determined by careful construction and dimensioning in accordance with known magnetic circuit analysis techniques. Particular care must be taken with respect to the minimum lengths of the air gaps in the path of the useful flux phi while the stray flux $phi_s$ should also be minimized. Yoke I is made from a material with a low magnetic resistance and can be air. It is highly dependent upon the shaping of the magnetic circuit, the magnetic refraction angle to the air gap, etc. It will be recognized that FIG. 3 is a schematic diagram of a usable magnetic coupling and not necessarily a refined embodiment thereof.

Figure 4:
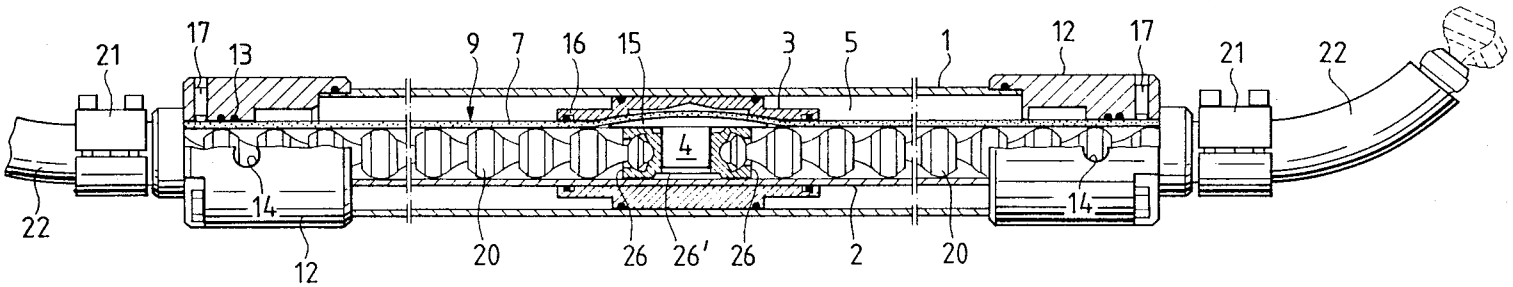
FIG. 4 is a more detailed illustration of an apparatus according to FIG. 1 with a transmission member and guide means.

FIG. 4 shows in more detail the drive described in connection with FIG. 1 and including the transmission member 20 within coaxial tube 2 and interconnected by the collar-shaped attachment clips 26 which are operatively connected to member 4. In this embodiment, the force transmission or transfer means 20 comprises a spherical joint link chain which, as shown, must be separated somewhat by attachment clips 26 held together by a connecting bridge 26'. Member 4, or magnet 4', of annular piston 3 engages in the space between the ends of the chain links. Advantageously, the connecting bridge 26', shown in section, is constructed in such a way that its circumference except for the slot to receive member 4 is adapted to the profile of the coaxial tube and can slide freely therein. Member 4 which projects away from annular piston 3 toward the center then extends into the pistonlike connecting bridge so as to fit well therein, in such a way that no disturbing looseness occurs during reciprocating movement. The collar-shaped attachment clips 26 are attached to connecting bridge 26'. The spherical joint element chain ends holding together the chain are inserted in clips 26. This type of attachment, which is one of many possibilities, permits simple fitting, repair, replacement and maintenance after removing one of the two end pieces 12.

Each chain link is spacially separated from its neighbor by a conical jacket as shown at the right-hand side of the drive depicted in FIG. 4 at the outlet end of guide means 22. The elements are relatively rotatable about their longitudinal axes. Thus, the chain can be bent about a predetermined radius and also can be twisted without a state of stress arising. However, if use is to be made of such a stress state in order, for example, to transfer a rotary movement in addition to the translational movement, to the ends of the chain where the movement is removed or used, then a freely bendable but torsionally stiff force transmission element is used. For this purpose, a key and slot arrangement between adjacent ones of the links can be employed.

Guide means for guiding the force transmission member extend away from the sockets 11 at the end of the drive mechanism. These guide means 22 also extend along the desired path, i.e., they constitute continuations of the path up to the point at which the action of the force produced in the drive is desired. Guide means 22 can be correspondingly bent solid tubes or slotted tubes and are advantageously slotted to be able, for example, to remove an action at a particular point in the path course in order to measure movements or to lubricate or maintain the chain or the like. The tubular guide means 22 are simply mounted on the drive socket 11 and can be attached with a clamp or flange arrangement.

For applications which require only the stroke or movement action of one side of the drive, the drive cylinder is closed at one end and a force transmission member 20, such as the spherical joint link chain, is attached to only one side of piston 3. The full travel length is naturally maintained and can be metered in the same way as when force is used at both ends. Metering in this context is intended to mean, for example, that a full travel or stroke is subdivided into several movement sequences instead of remaining one continuous sequence. It is also possible to perform a variety of strokes within the length of the maximum stroke, particularly in conjunction with slotted guide means where it is possible to make use of the action "on the way". This reveals an inherent advantage of the invention. The force produced by means of the pneumatic or hydraulic system is supplied by member 4 projecting into the chain (or magnet 4') to a neutral center fiber of the force transmission means 20. In the case of curvature, the force-transmitting chain, considered here as the neutral central fiber of a force transmission system, retains the original speed generated in the drive cylinder, i.e., there are essentially no accelerations or decelerations in the general path course. This can be utilized in that, when action is taken out "along the way", this can take place as close as possible to the chain, particularly in the vicinity of pronounced curvatures.

Another important advantage is the easily produced seal between pressure chamber 8 and the environment. The force transmission member does not form part of the sealing connection and can be manifested by various shapes and modes within the aforementioned limits and can, in part, be interchanged. The pressure chamber seal is structurally constant and requires no adaptation when chosing the particular form of the force transmission member.

Figure 5:
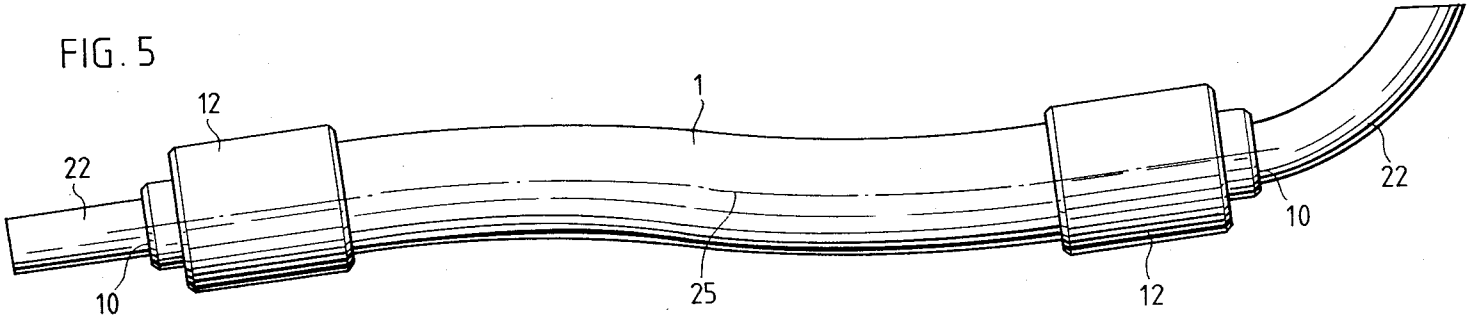
FIG. 5 is a side elevation of an apparatus in accordance with the invention following a curvilinear path configuration.
Figure 6:
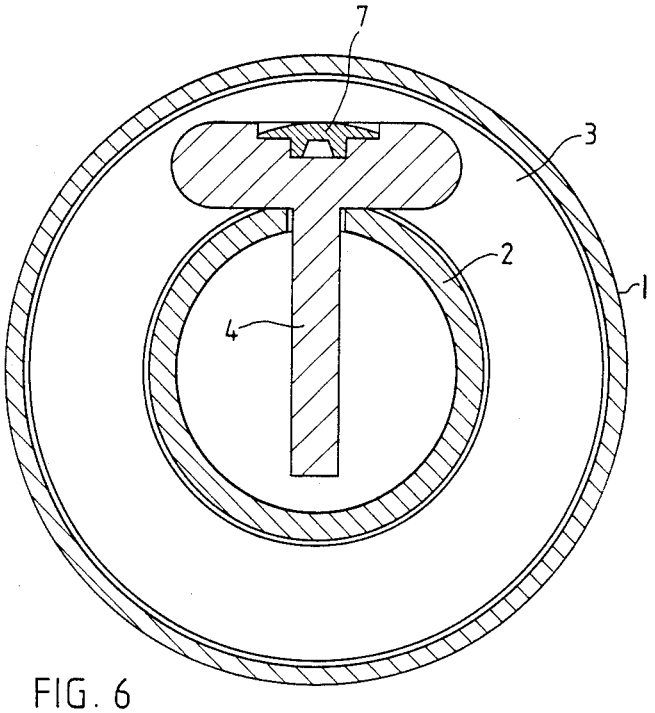
FIG. 6 is a transverse sectional view along line VI—VI of FIG. 1.

FIG. 5 shows a more general form of the drive which, together with the guide means, follows a slightly oscillating path configuration. It has been deliberately decided in the present discussion not to illustrate or discuss exotic path configurations, even for illustrative purposes. The oscillating or twisting neutral fiber 25 of the drive, of which only outer tube 1 and end pieces 12 is seen, has a usable displacement between the two openings 10. This displacement makes it possible to make a decision regarding the use or non-use of a linear drive. This is also one of the strong points of the drive according to the invention. The guidance means 22 follows along the desired path configuration as previously discussed. It is again pointed out that the linear embodiment as a special case with a linear path configuration is preferred because advantages of the invention are also usable in a straight course and particularly where no curvature is required it is possible to produce a drive having no curvature with exactly the same components.

While certain advantageous embodiments have been chosen to illustrate the invention, it will be understood by those skilled in the art that various changes and modifications can be made therein without departing from the scope of the invention as defined in the appended claims.

What is claimed is:

1. A drive mechanism comprising a first tubular member following a predetermined path;

a second tubular member substantially concentrically surrounding and spaced from said first member and following the same path;

means for closing the space between said first and second members at longitudinally spaced locations and restraining said members against relative longitudinal movement, thereby defining an elongated annular chamber;

a piston slidably surrounding said first member in said chamber;

means for selectively introducing fluid under pressure into said chamber to cause longitudinal movement of said piston;

a flexible transmission member extending through said first tubular member; and means for coupling the movement of said piston through the wall of said first tubular member to exert force on said transmission member.

2. A mechanism according to claim 1 wherein said transmission member is movable in any direction in space.

3. A mechanism according to claim 1 wherein said first tubular member includes means defining a longitudinally extending slot; and seal means for closing said slot in a fluid-tight manner;

and wherein said means for coupling includes means attached to said piston for moving a portion of said seal means from said slot and extending through said slot to engage and move said transmission member in either direction.

4. A mechanism according to claim 1 wherein said first tubular material is nonmagnetic, and wherein said means for coupling includes a first magnetic body attached to and movable with said piston; and a second magnetic body attached to said transmission member and magnetically coupled to said first magnetic body for longitudinal movement therewith.

5. A mechanism according to claim 4 and further comprising first and second guide means connected respectively to opposite ends of said first tubular member for receiving and guiding said motion transmission member, each of said guide means following an extension of the path followed by said tubular members.

6. A mechanism according to claim 5 wherein said motion transmission member comprises a plurality of links each having a generally spherical ball at one end and a socket at the other end to tightly receive a ball of an adjacent link, said links being joined together to form a substantially unstretchable chain capable of transmitting force wherein each link can move conically relative to a following link and can rotate freely relative to adjacent links.

7. A mechanism according to claim 5 wherein said motion transmission member comprises a substantially unstretchable, freely bendable member capable of absorbing tensile and compressive stresses and having torsionally stiff movement characteristics.

8. A mechanism according to claim 7 wherein said motion transmission member comprises a substantially unstretchable, freely bendable member capable of absorbing tensile and compressive stresses and having torsionally stiff movement characteristics.

9. A mechanism according to claim 3 and further comprising first and second guide means connected respectively to opposite ends of said first tubular member for receiving and guiding said motion transmission member, each of said guide means following an extension of the path followed by said tubular members.

10. A mechanism according to claim 4 wherein said motion transmission member comprises a plurality of links each having a generally spherical ball at one end and a socket at the other end to tightly receive a ball of an adjacent link, said links being joined together to form a substantially unstretchable chain capable of transmitting force wherein each link can move conically relative to a following link and can rotate freely relative to adjacent links.

11. A mechanism according to claim 3 wherein said motion transmission member comprises a plurality of links each having a generally spherical ball at one end and a socket at the other end to tightly receive a ball of an adjacent link, said links being joined together to form a substantially unstretchable chain capable of transmitting force wherein each link can move conically relative to a following link and can rotate freely relative to adjacent links.

12. A mechanism according to claim 1 wherein said motion transmission member comprises a plurality of links each having a generally spherical ball at one end and a socket at the other end to tightly receive a ball of an adjacent link, said links being joined together to form a substantially unstretchable chain capable of transmitting force wherein each link can move conically relative to a following link and can rotate freely relative to adjacent links.

13. A mechanism according to claim 1 and further comprising first and second guide means connected respectively to opposite ends of said first tubular member for receiving and guiding said motion transmission member, each of said guide means following an extension of the path followed by said tubular members.

14. A mechanism according to claim 5 wherein each of said guide means includes means defining access locations for gaining access to said motion transmission member.

15. A mechanism according to claim 14 wherein each of said guide means comprises a tube and wherein each of said access locations is a slot in one of said tubes.

16. A mechanism according to claim 14 wherein each of said guide means comprises a tube having a slot extending along its entire length.

17. A mechanism according to claim 16 wherein said slot follows a spiral path around the central axis of said tube.

* * * * *